United States Patent [19]

Carlson et al.

[11] 4,070,271

[45] Jan. 24, 1978

[54] CATALYTIC OXIDATION OF MERCAPTANS AND REMOVAL OF NAPHTHENIC ACIDS, CATALYST TOXINS, AND TOXIN PRECURSORS FROM PETROLEUM DISTILLATES

[75] Inventors: David H. J. Carlson, Park Ridge; Peter Urban, Northbrook, both of Ill.

[73] Assignee: UOP Inc., Des Plaines, Ill.

[21] Appl. No.: 774,283

[22] Filed: Mar. 4, 1977

Related U.S. Application Data

[63] Continuation-in-part of Ser. No. 615,449, Sept. 22, 1975, abandoned.

[51] Int. Cl.[2] ..... C10G 27/06; C10G 19/02

[52] U.S. Cl. ..... 208/206; 208/263

[58] Field of Search ..... 208/206, 207, 263, 182, 208/183

[56] References Cited

U.S. PATENT DOCUMENTS

| | | | |
|---|---|---|---|
| 2,882,224 | 4/1959 | Gleim et al. | 208/206 |
| 2,921,020 | 1/1960 | Urban et al. | 208/206 |
| 2,988,500 | 6/1961 | Gleim et al. | 208/206 |
| 3,371,031 | 2/1968 | Strong | 208/206 |
| 4,033,860 | 7/1977 | Carlson | 208/206 |

*Primary Examiner*—George Crasanakis

*Attorney, Agent, or Firm*—James R. Hoatson, Jr.; Robert W. Welch; William H. Page, II

[57] ABSTRACT

A process is disclosed for the catalytic oxidation of mercaptans in a sour petroleum distillate containing difficultly oxidizable mercaptans, catalyst toxins and catalyst toxin precursors. The process comprises treating said distillate in contact with an alkaline solution and extracting naphthenic acids from the distillate; treating the substantially naphthenic acids-free distillate in contact with an oxidizing agent and an alkaline solution of a metal phthalocyanine catalyst, oxidizing the residual catalyst toxins and toxin precursors contained therein and converting a portion of the mercaptans to disulfides; passing the resulting reaction mixture through a bed of solid adsorbent particles and adsorbing the oxidized toxins and toxin precursors and the metal phthalocyanine solution thereon; treating the toxin-free and toxin precursor-free distillate in contact with an alkaline solution and a supported metal phthalocyanine catalyst in the presence of an oxidizing agent; and recovering a distillate substantially free of mercaptans.

14 Claims, 1 Drawing Figure

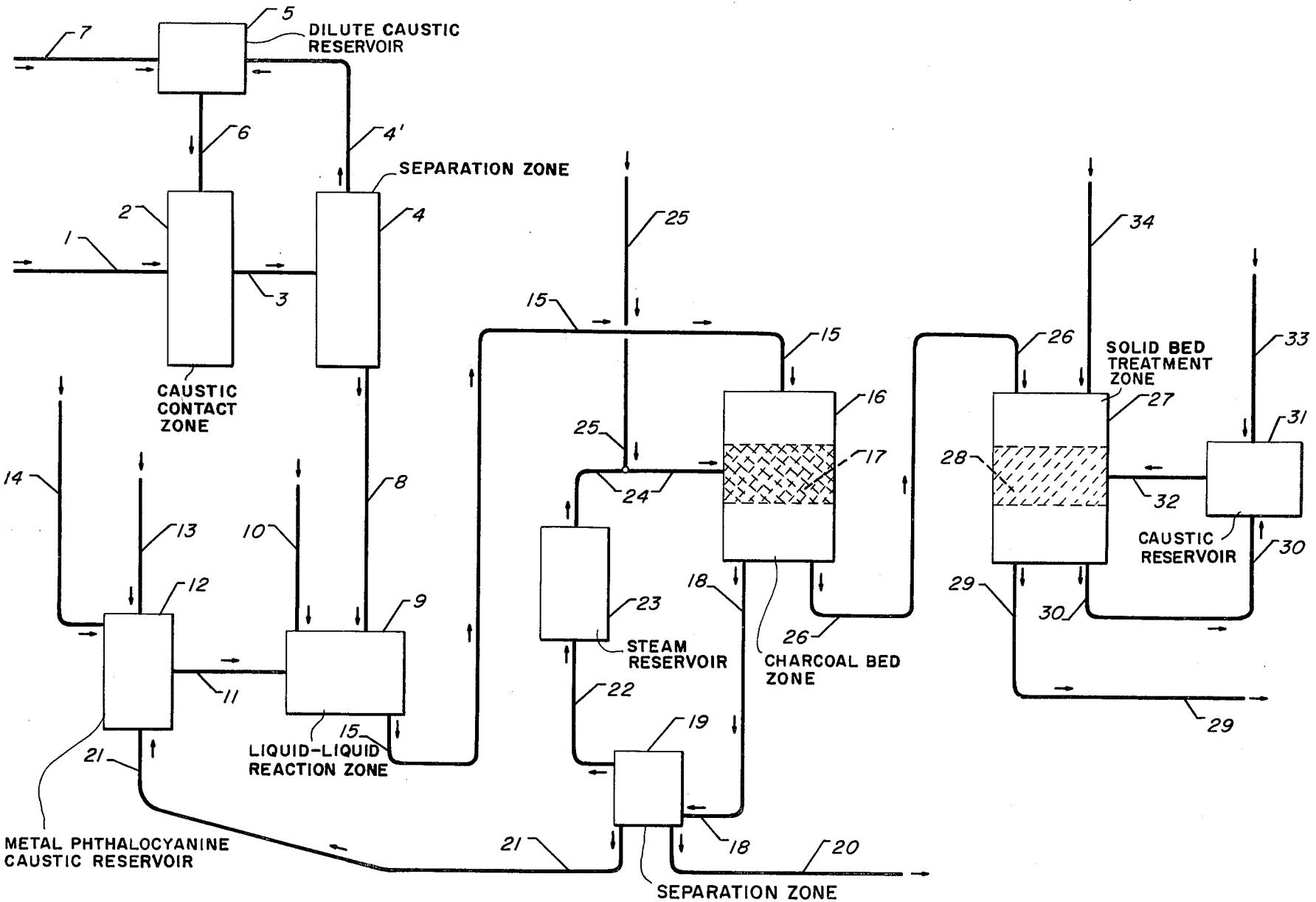
DILUTE CAUSTIC RESERVOIR
SEPARATION ZONE
CAUSTIC CONTACT ZONE
LIQUID-LIQUID REACTION ZONE
METAL PHTHALOCYANINE CAUSTIC RESERVOIR
STEAM RESERVOIR
CHARCOAL BED ZONE
SEPARATION ZONE
SOLID BED TREATMENT ZONE
CAUSTIC RESERVOIR

CATALYTIC OXIDATION OF MERCAPTANS AND REMOVAL OF NAPHTHENIC ACIDS, CATALYST TOXINS, AND TOXIN PRECURSORS FROM PETROLEUM DISTILLATES

CROSS-REFERENCE TO RELATED APPLICATIONS

This application is a continuation-in-part of a copending application Ser. No. 615,449 filed Sept. 22, 1975 and now abandoned.

This invention relates to a process for the conversion of difficultly oxidizable mercaptans contained in a sour petroleum distillate. Processes for the treatment of sour petroleum distillates wherein the distillate is contacted with a metal phthalocyanine catalyst in the presence of an oxidizing agent at alkaline reaction conditions, have become well known and widely practiced in the petroleum refining industry. Said processes are typically designed to effect the catalytic oxidation of offensive mercaptans contained in a sour petroleum distillate and thereby convert said mercaptans to innocuous disulfides — a process commonly referred to as sweetening.

The sweetening process has heretofore been effected in a liquid-liquid treating system wherein the sour petroleum distillate is contacted with a metal phthalocyanine catalyst dispersed in an aqueous caustic solution. The mercaptans are converted to disulfides at the interface of the immiscible solutions in the presence of an oxidizing agent — usually air.

More recently, the sweetening process has been effected in a fixed bed system wherein the metal phthalocyanine catalyst is adsorbed or impregnated on a solid adsorbent support disposed as a fixed bed in a treating or contacting vessel, the sour petroleum distillate being passed in contact with an aqueous caustic solution and the supported catalyst in the presence of an oxidizing agent. The caustic solution is regenerated or replaced as it becomes spent through the accumulaton of acidic and other non-hydrocarbon impurities, and the supported metal phthalocyanine catalyst is reactivated as required utilizing, in most cases, relatively simple in situ regeneration procedures.

The sour petroleum distillates subjected to the sweetening process differ widely in composition depending on the source of the petroleum from which the distillate was derived, the boiling range of the distillate, and possibly the method of processing the petroleum to produce the distillate. The differences include the character and concentration of the mercaptans contained in the distillate, and also the character and concentration of the acidic and other non-hydrocarbon impurities. Thus, while the fixed bed system is very effective in the treatment of petroleum distillates containing primary and secondary mercaptans, the system is somewhat less effective in the treatment of those petroleum distillates containing the difficultly oxidizable mercaptans, that is, the caustic insoluble, highly hindered branched chain and aromatic thiols — especially the higher molecular weight tertiary and polyfunctional mercaptans. This results in large measure from the presence and character of the acidic and other non-hydrocarbon impurities which occur in greater concentration in the higher boiling distillates, and which function as catalyst toxins, or catalyst toxin precursors convertible to toxins at treating conditions. These materials — usually phenolic materials, and particularly higher molecular weight aliphatic and naphthenic acids — while not necessarily adsorbable on the solid adsorbent catalyst support per se, are readily adsorbed in the higher oxidation state induced by the oxidative treating conditions. These oxidized materials become adsorbed on the supported catalyst from the distillate to promote catalyst deactivation and/or are extracted from the distillate by the caustic solution which is typically recycled over the supported catalyst. The caustic solution must therefore be subjected to more frequent regeneration or replacement to preclude an accelerated accumulation of toxins on the catalyst, and the catalyst must be subjected to more frequent and more stringent catalyst reactivation procedures.

It is therefore an object of this invention to present a novel and improved process for the catalytic oxidation of mercaptans in a sour petroleum distillate containing difficultly oxidizable mercaptans, catalyst toxins and catalyst toxin precursors and, in one of its broad aspects, the present invention embodies a process which comprises treating said distillate in contact with an alkaline solution and extracting naphthenic acids from said distillate, said alkaline solution having a pH of from about 8 to about 10; treating at least a portion of the substantially naphthenic acids-free distillate in contact with an oxidizing agent and an alkaline solution of a metal phthalocyanine catalyst having a pH of from about 9 to about 14, oxidizing the residual catalyst toxins and catalyst toxin precursors contained therein, and converting a portion of the mercaptans to disulfides; passing at least a portion of the resulting reaction mixture through a bed of solid adsorbent particles and adsorbing the oxidized toxins and toxin precursors and the metal phthalocyanine solution thereon; treating at least a portion of the toxin-free and toxin precursor-free distillate in contact with an alkaline solution and a supported metal phthalocyanine catalyst in the presence of an oxidizing agent at a pH of from about 9 to about 14; and recovering the resultant distillate substantially free of mercaptans.

One of the more specific embodiments of this invention resides in a process for the catalytic oxidation of mercaptans in a sour petroleum distillate containing difficultly oxidizable mercaptans, catalyst toxins and toxin precursors which comprises treating said distillate in contact with a caustic solution at a temperature of from about 10° to about 200° C. and a pressure of from about 1 to about 100 atmospheres and extracting naphthenic acids from said distillate, said caustic solution having a pH of from about 8 to about 10; treating at least a portion of a substantially naphthenic acids-free distillate in contact with air and a caustic solution of cobalt phthalocyanine having a pH of from about 9 to about 14, oxidizing the residual catalyst toxins and toxin precursors contained therein, and converting a portion of the mercaptans to disulfides at a temperature of from about 10° to about 100° C. and a pressure of from about 1 to about 100 atmospheres; passing at least a portion of the resulting reaction mixture through a bed of activated charcoal at a liquid hourly space velocity of from about 0.5 to about 10 and adsorbing the oxidized toxins and toxin precursors and cobalt phthalocyanine solution thereon at a temperature of from about 10° to about 100° C. and a pressure of from about 1 to about 100 atmospheres; treating at least a portion of the toxin-free and toxin precursor-free distillate in contact with a caustic solution and an activated charcoal-supported cobalt phthalocyanine catalyst in the presence of air at a temperature of from about 10° to about 250° C. and a pressure of from about 1 to about 100 atmospheres, said caustic solution having a pH of from about 9 to about 14; and recovering the resultant distillate substantially free of mercaptans.

Other objects and embodiments of this invention will become apparent in the following detailed specification.

As heretofore stated, the present invention is concerned with a process for the catalytic oxidation of mercaptans in a sour petroleum distillate containing difficultly oxidizable mercaptans, catalyst toxins and catalyst toxin precursors convertible to toxins at treating conditions. In accordance with the process of this invention, the sour petroleum distillate is initially contacted with an alkaline solution whereby naphthenic acids are extracted from the distillate. The extraction operation, which is suitably effected at a temperature of from about 10° to about 100° C. and a pressure of from about 1 to about 100 atmospheres, is also effective to separate any hydrogen sulfide which may occur in the distillate. The alkaline solution employed is preferably an aqueous caustic solution having a pH of from about 8 to about 10. However, other alkaline solutions may be employed, for example alkaline solutions comprising potassium hydroxide, lithium hydroxide, rubidium hydroxide, cesium hydroxide, barium hydroxide, strontium hydroxide, calcium hydroxide, manganese hydroxide, beryllium hydroxide, ammonium hydroxide, etc., and also alkaline solutions comprising pyridine, piperadine, picolin, lutidine, quinoline, pyrrole, indole, carbazole, acridine, tetrabutyl ammonium hydroxide, tetraamyl ammonium hydroxide, tetrapropyl ammonium hydroxide, tetraamyl ammonium methoxide, tetraethyl ammonium ethoxide, diethylamine, triethylamine, tetramethylenediamine, phenylenediamine, and the like.

In any case, the resultant distillate, substantially free of naphthenic acids, is subsequently contacted with an alkaline solution of a metal phthalocyanine catalyst in the presence of an oxidizing agent. The oxidation may be accelerated or carried to a greater extent utilizing ozone or hydrogen peroxide as an oxidizing agent. However, the oxidizing agent in this and subsequent process steps being preferably air. The alkaline solution may be substantially as heretofore described, but with a pH of from about 9 to about 14. Typically, the alkaline solution will be a 5–20 wt. % caustic solution containing 0.0001–10 wt. % metal phthalocyanine and utilized in from about a 1:1 to about a 1:20 volume ratio with the distillate. In the process of contacting the distillate with a metal phthalocyanine catalyst, residual toxins and toxin precursors contained in the distillate are oxidized to higher molecular weight products, and a portion of the mercaptans converted to disulfides. In this liquid-liquid treating system, a temperature of from about 10° to about 100° and a pressure of from about 1 to about 100 atmospheres can be utilized. This liquid-liquid treating system may further incorporate various promoters comprising metal cations such as iron, cobalt, manganese, vanadium, etc.; or the promoters may comprise quinones such as quinone, benzoquinone, hydroquinone, alpha-naphthoquinone, anthraquinone, diphenoquinone, beta-naphthoquinone, 2-hydroxy-1,4-naphthoquinone, 2-methoxy-1,4-naphthoquinone, 4-methoxy-1,2-naphthoquinone, 2-hydroxy-1,4-naphthohydroquinone, chlorohydroquinone, 2-methyl-3-bromo-1,4-naphthoquinone, 2-phenyl-1,4-benzoquinone, 3-nitro-1,2-naphthoquinone, etc.; or various dyes including typical azo compounds such as picramic acid, or azo compounds derived from benzadine, diaminofluorine, toluidine, 4,4'-diaminoazobenzene, 4,4'-diaminodiphenylurea, N-p-aminobenzoyl-p-phenylenediamine, etc.; or other chemical promoters such as hydrogen peroxide, halogen compounds containing chlorine, bromine or iodine; or other methods of promotion such as the introduction of ultraviolet light to the caustic material; all in addition to the metal phthalocyanine catalyst.

The reaction mixture from the last mentioned liquid-liquid treating step, comprising the alkaline metal phthalocyanine solution, petroleum distillate, residual mercaptans and higher molecular weight toxin and toxin precursor oxidation products, is passed through a bed of activated charcoal or other suitable adsorbent material such as high surface silica, alumina, silica-alumina, and the like, whereby said oxidation products, as well as the alkaline metal phthalocyanine solution, are adsorbed and separated from the distillate. The reaction mixture is suitably processed through the charcoal bed at a liquid hourly space velocity (LHSV) of from about 0.5 to about 10, and at a temperature of from about 10° to about 100° C., and at a pressure of from about 1 to about 100 atmospheres.

At least a portion of the resulting toxin-free and toxin precursor-free distillate is subsequently passed through a treating zone at a temperature of from about 10° to about 250° C. and at a pressure of from about 1 to about 100 atmospheres. In the treating zone, the distillate is contacted with an alkaline solution and a supported metal phthalocyanine catalyst in the presence of an oxidizing agent, the contact time being equivalent to a LHSV of from about 0.5 to about 10. The alkaline solution, preferably an aqueous caustic solution, has a pH of from about 9 to about 14.

The improved process of the present invention is especially advantageously used in the treatment of heavier sour petroleum distillates including particularly kerosenes and jet fuels. These heavier petroleum distillates generally contain the difficultly oxidizable mercaptans and also catalyst toxins and/or catalyst toxin precursors. The mercaptan sulfur content of the various sour petroleum distillates will range from about 5 ppm for light petroleum distillates, such as natural gas, to about 450 ppm or more for the heavier petroleum distillates, such as kerosene. While the difficultly oxidizable mercaptans contained in a sour petroleum distillate are difficult to characterize, they will generally comprise branched chain alkyl mercaptans such as 1,1-dimethyl-1-pentanethiol, 1-methyl-1-ethyl-1-pentanethiol, 1,1-dimethyl-1-hexanethiol, 1-methyl-1-ethyl-1-hexanethiol, 1,1-diethyl-1-hexanethiol, 2-methyl-2-propanethiol, 2-methyl-2-butanethiol, 1,1,3,3-tetramethyl butanethiol, and the like, and also aromatic mercaptans including thiophenol, 2,3-dimethylthiophenol, 2-mercaptophenol, 3-mercaptophenol, 4-mercaptophenol, etc. Although the present process is particularly applicable to the treatment of the heavier petroleum distillates, it is understood that the process may also be used for the treatment of other lower boiling sour petroleum distillates including normally gaseous, gasoline, naphtha, etc., petroleum fractions.

The metal phthalocyanine catalyst employed herein can be any of the various metal phthalocyanines heretofore employed in the sweetening of sour petroleum distillates, especially the Group VIII metal phthalocyanines such as cobalt phthalocyanine, iron phthalocyanine, nickel phthalocyanine, platinum phthalocyanine, palladium phthalocyanine, rhodium phthalocyanine, ruthenium phthalocyanine, osmium phthalocyanine, iridium phthalocyanine, or mixtures thereof. Other metal phthalocyanines which may be used include magnesium phthalocyanine, titanium phthalocyanine, hafnium phthalocyanine, vanadium phthalocyanine, tantalum phthalocyanine, molybdenum phthalocyanine, manganese phthalocyanine, copper phthalocyanine, silver phthalocyanine, zinc phthalocyanine, tin phthalocyanine, and the like. The metal phthalocyanine is preferably employed as a derivative thereof, the commercially available sulfonated derivatives, for example, cobalt phthalocyanine monosulfonate, cobalt phthalocyanine disulfonate, or mixtures thereof, being particularly preferred. While the sulfonated derivatives are preferred, other derivatives, particularly the carboxylated derivatives, may be employed.

The process of the present invention embodies the use of a non-supported metal phthalocyanine catalyst in a liquid-liquid treating system, and also the use of a supported metal phthalocyanine catalyst in a fixed bed treating system. In the latter case, the catalyst support may comprise any of the various charcoals produced by the destructive distillation of wood, peat, lignite, nut shells, bones and other carbonaceous matter, and preferably such charcoals as have been heat treated and/or chemically treated to form a highly porous particle structure of increased adsorbent capacity, and generally defined as activated carbon or charcoal.

Preferred activated charcoals for use as a catalyst support, as well as for the adsorption of the oxidized toxins, oxidized toxin precursors and alkaline metal phthalocyanine solution from the petroleum distillate as heretofore described, include vegetable-derived charcoals, lignite coal-derived charcoals, bituminous coal-derived charcoals, peat-derived charcoals and petroleum black-derived charcoals. Such charcoals are exemplified by Nuchar, which is a charcoal derived from vegetable sources such as ground wood pulp and available from Westvaco Company; Hydrodarco charcoal (also known as Darco), which is derived from lignite coal and available from the Atlas Chemical Company; Norit charcoal, which is derived from peat and available from the Norit Company; Columbia charcoal, which is derived from petroleum black and available from the Union Carbide Company; and Pittsburg charcoal, which is derived from bituminous coal and available from the Calgon Company.

Suitable metal phthalocyanine catalyst supports further include the naturally occurring clays and silicates, for example, diatomaceous earth, fuller's earth, kieselguhr, attapulgus clay, feldspar, montmorillonite, haloysite, kaolin, and the like, and also the naturally occurring or synthetically prepared refractory inorganic oxide such as alumina, silica, zirconia, thoria, boria, etc., or combinations thereof, like silica-alumina, silica-zirconia, alumina-zirconia, etc. Any particular solid adsorbent material is selected with regard to its stability under conditions of its intended use. For example, in the treatment of a sour petroleum distillate the solid adsorbent carrier material should be insoluble in, and otherwise inert to, the aqueous caustic solutions and the petroleum distillate at treating conditions.

The supported metal phthalocyanine catalyst preferably comprises from about 0.0001 to about 10 wt. % metal phthalocyanine. In the liquid-liquid treating system, preferably utilizing a 0.5–20 wt. % aqueous caustic solution, the metal phthalocyanine preferably comprises from about 0.0001 to about 10 wt. % of said caustic solution.

The aforementioned adsorbent material utilized for the adsorption of the oxidized toxins, oxidized toxin precursors and alkaline metal phthalocyanine solution from the petroleum distillate, may be regenerated by known methods including steam regeneration whereby the charcoal is contacted with steam at a temperature of from about 450° to about 560° C. or more at a pressure of from about 1 to about 100 atmospheres. Alternatively, regeneration can be effected by solubilizing the adsorbed toxins utilizing sulfuric acid, liquid sulfur dioxide, ammonia or other suitable solubilizer, and washing the solubilized materials from the adsorbent.

Referring now to the attached drawing, the process of the present invention is exemplified as a general flow scheme employed without an attempt to give details about heaters, condensers, pumps, compressor valves, valves, process control equipment, etc. In the attached drawing, the sour petroleum distillate is charged through line 1 to a contacting vessel 2. The sour petroleum distillate is contacted in said vessel 2 with an aqueous caustic solution having a pH of from about 8 to about 10. The caustic solution is charged to the contacting vessel 2 from the caustic reservoir 5 by means of line 6. The level of caustic in the reservoir may be maintained by caustic charged to the reservoir 5 through line 7, or the caustic may be recovered from separation zone 4 and recycled to the caustic reservoir 5 through line 4'. After sufficient contact in contact vessel 2 by means of intimate stirring, the petroleum distillate and the aqueous caustic solution are removed through line 3 and charged to a separation zone 4. In the separation zone 4, the caustic solution is separated from the petroleum distillate which has become substantially naphthenic acid-free as a result of contact with the caustic solution in contact vessel 2. The petroleum distillate, substantially free of naphthenic acids, is removed from separation zone 4 by means of line 8 and charged to a reaction zone 9. Reaction zone 9 contains the naphthenic acids-free petroleum distillate and air which may be charged to the reaction zone 9 through line 10. The air and petroleum distillate are reacted in the presence of an aqueous caustic solution of a metal phthalocyanine catalyst having a pH of from about 9 to about 14, which solution is charged through line 11 to reaction zone 9. The caustic metal phthalocyanine solution is maintained in the metal phthalocyanine-caustic reservoir 12. The caustic solution or mixture of the catalyst is maintained by the proper charge of caustic through line 14 to the reservoir 12, and through the charge of fresh metal phthalocyanine through line 13. The petroleum distillate is reacted with air in reaction zone 9 to convert catalyst toxin and toxin precursor materials to substances possessing a greater molecular weight. The petroleum distillate, oxidized toxins and toxin precursors, and the caustic metal phthalocyanine solution are withdrawn from reaction zone 9 through line 15 and charged to an extraction zone 16 containing a charcoal bed 17. The petroleum distillate and other impurities are allowed to pass over the charcoal bed 17 and gravitate downflow whereby the catalyst dissolved in the caustic and the oxidized toxin and toxin precursor materials are adsorbed on the charcoal and extracted from the distillate. The distillate is then recovered from the extraction zone 16 through line 26.

The adsorbed caustic metal phthalocyanine solution and oxidized toxin and toxin precursor materials may be removed from the charcoal bed 17 by means of steam regeneration, steam being charged to zone 16 through line 24. The steam may be charged from a steam reservoir 23, or the steam may be charged from an external source through line 25 and line 24. The steam condensate, containing water, caustic metal phthalocyanine and oxidized toxin and toxin precursor materials, may be exited from the extraction zone 16 through line 18 and charged to separation zone 19. The oxidized toxin and toxin precursor materials are removed from separation zone 19 through line 20. The caustic metal phthalocyanine solution may be recycled through line 21 to the metal phthalocyanine-caustic reservoir 12 for use in reaction zone 9 by way of line 11. The water which is recovered in separation zone 19 can be recycled to the steam reservoir 23 by means of line 22. The naphthenic acids-free and toxin and toxin precursor-free petroleum distillate is charged to treating zone 27 through line 26. Treating zone 27 contains a solid support with the metal phthalocyanine catalyst impregnated thereon. The mercaptan compounds contained in the petroleum distillate are oxidized or converted to disulfide materials on passage over the supported metal phthalocyanine disposed in bed 28 in the presence of air which is supplied to said zone 27 through line 34, and in the presence of an aqueous caustic solution which may be intermittently or continuously charged to the metal phthalocyanine catalyst bed by means of line 32. The substantially mercaptan-free petroleum distillate is exited from the process flow through line 29. The recovered caustic material is separated from the petroleum distillate within the treating zone 27 by means known to the art, and exited from said treating zone by way of line 30 for passage to the caustic reservoir 31. The caustic reservoir 31 may be maintained at a constant level by recycling the caustic through line 30, or the level may be maintained by caustic charged from an external source through line 33 to caustic reservoir 31.

The following examples are given to illustrate the process of the present invention, however, without unduly limiting the same.

EXAMPLE I

In this example, a petroleum distillate kerosene was utilized which contained a mercaptan sulfur content of 434 ppm and was found to repeatedly deposit accumulations of toxin materials on a fixed bed treating unit and in the caustic medium of the mercaptan fixed bed treating unit. An analysis of the kerosene revealed the following physical characteristics set forth in Table I below:

TABLE I

| | |
|---|---|
| Mercaptan Sulfur | 434 ppm |
| Hydrogen sulfide, sulfur | <1 ppm |
| Copper | 0.021 mg/liter |
| [1]Acid Number | 0.004 mg KOH/gram |
| [2]Saybolt Color | 30 |
| APIGR | 42.9 |
| SPGR | 0.8114 |
| Distillation | |
| IBP ° F. | 356 |
| 10 | 369 |
| 30 | 385 |
| 50 | 404 |
| 70 | 428 |
| 90 | 463 |
| 95 | 477 |
| EP ° F. | 490 |

[1]ACID NUMBER is determined by titration with potassium hydroxide
[2]SAYBOLT COLOR is measured after 20 hour acceleration The aforementioned kerosene was treated in a beaker in the presence of oxygen, sodium hydroxide possessing a pH of 14 and a catalyst comprising cobalt phthalocyanine monosulfonate dispersed on a 12 × 30 Hydrodarco[3] charcoal to the quantity of 150 milligrams of the metal phthalocyanine compound per 100 cubic centimeters of the charcoal. The 12 × 30 Hydrodarco charcoal was determined to have the physical properties set forth in Table II below:

TABLE II

| | |
|---|---|
| Surface Area | 600 $m^2/g$ |
| Density | 0.40–0.45 g/cc |
| Bed Density | 235 $lbs/ft^3$ |
| Sieve Analysis | |
| % Retained on No. 12 Sieve | 5 |
| % Through No. 30 Sieve | 5 |
| Uniformity Coefficient | 1.7 or less |
| Abrasion % Retention | 75 min. |
| Ash Content | 17% |
| Moisture Content | 6% |

3. Hydrodarco was purchased from the Atlas Chemical Division, Wilmington, Del.

The kerosene was shaken with the catalyst, sodium hydroxide and air at ambient temperature and pressure for a period of time comprising 120 minutes, during which samples were extracted and analyzed for mercaptan content, said analysis being set forth in Table III below:

TABLE III

| TIME OF SAMPLE EXTRACTION | PPM MERCAPTAN IN KEROSENE |
|---|---|
| 0 | 434 |
| 10 | 30 |
| 20 | 19 |
| 30 | 9 |
| 60 | 3 |
| 90 | 1 |
| 120 | 1 |

This test indicates that the kerosene possessed 19 ppm mercaptan after 20 minutes of treating when the kerosene was not treated to remove naphthenic acids and catalyst-toxin precursors contained within the kerosene.

EXAMPLE II

In this example the kerosene distillate of Example I was contacted with dilute sodium hydroxide possessing a pH of about 9 to remove or extract naphthenic acids. The kerosene was separated from the dilute caustic and analyzed to determine its physical properties which are set forth in Table IV below:

TABLE IV

| | |
|---|---|
| Mercaptan Sulfur | 388 ppm |
| Hydrogen Sulfide, Sulfur | <1 ppm |
| Copper | 0.021 mg/liter |
| [4]Acid Number | 0.001 mg KOH/gram |
| [5]Saybolt Color | 30.0 |
| APIGR | 42.9 |
| SPGR | 0.8114 |
| Distillation | |
| IBP ° F. | 349 |
| 5 | 364 |
| 10 | 368 |
| 30 | 384 |
| 50 | 404 |
| 70 | 425 |
| 90 | 456 |
| 95 | 470 |
| EP ° F. | 490 |

[4]ACID NUMBER was determined by the same method as utilized in Table I.
[5]SAYBOLT COLOR was measured by the same method as utilized in Table I.

The kerosene was treated in the manner as set forth in Example I above, the results of the shake test being set forth in Table V below:

TABLE V

| TIME OF SAMPLE EXTRACTION | PPM MERCAPTAN IN KEROSENE |
|---|---|
| 0 | 388 |
| 10 | — |
| 20 | — |
| 30 | 13 |
| 60 | 4 |
| 90 | 1.4 |
| 120 | 1.3 |

It was found that the naphthenic acid removal was necessary to allow maximum effect of the unimpregnated charcoal bed of step (d) of the appended principal claim as a result of the accumulation of naphthenic acids on the charcoal bed.

EXAMPLE III

In this example 300 ml of the prewashed kerosene of Example II was reacted with air for a period of time comprising 10 minutes at a temperature of 23.9° C. and a pressure of 1 atmosphere in the presence of 150 ml of 10° Be sodium hydroxide containing 100 weight ppm cobalt phthalocyanine disulfonate. The kerosene was recovered from the liquid-liquid reaction system and found to contain 56 ppm mercaptan sulfur. The kerosene was subsequently percolated on a gravitational downflow direction through 100 cc of a fresh unimpregnated Hydrodarco charcoal, as exemplified in Example I, at ambient conditions of pressure and temperature and a liquid hourly space velocity of 1.0. The recovered percolated kerosene was found to be toxin-precursor free, catalyst-caustic free and to possess a mercaptan level of 27 ppm. The recovered percolated kerosene was treated with a cobalt phthalocyanine monosulfonate catalyst impregnated upon the Hydrodarco fixed solid bed as set forth in Example I including the presence of the oxygen and sodium hydroxide possessing a pH of 14. The result of the treatment of the recovered percolated kerosene being set forth in Table VI below:

TABLE VI

| TIME OF SAMPLE EXTRACTION | PPM MERCAPTAN IN KEROSENE |
|---|---|
| 0 | 27 |
| 10 | 13 |
| 15 | 11 |
| 20 | 6 |
| 30 | 7 |
| 60 | — |
| 90 | — |
| 120 | — |

The unexpected results of the present invention are exemplified by a comparison of the mercaptan content in the example not utilizing the prewash, liquid-liquid reaction system and percolation techniques of the present invention in comparison with this example. The mercaptan content of Example I (Table III) after 20 minutes time was 19 ppm. In the process of this invention the mercaptan content was only 6 ppm at the same time interval of treatment. The decrease in mercaptan content is critical in that the resultant kerosene of Example III (Table VI) contained a three-fold diminishment of mercaptan compounds in comparison with Example I (Table III).

EXAMPLE IV

In this example the experiment of Example III is performed with the following substitutions of parameters. Potassium hydroxide is substituted for all sodium hydroxide, the charcoals are both derived from vegetable sources, the cobalt phthalocyanine monosulfonate is replaced with vanadium phthalocyanine monosulfonate, the cobalt phthalocyanine disulfonate is replaced with vanadium phthalocyanine tetrasulfonate and the petroleum distillate is a mercaptan-containing FCC gasoline. The results of Example III are found to be repeated within the scope of the present invention.

We claim as our invention:

1. A process for the catalytic oxidation of mercaptans in a sour petroleum distillate containing difficultly oxidizable mercaptans, catalyst toxins and toxin precursors which comprises:

a. treating said distillate in contact with an alkaline solution and extracting naphthenic acids from said distillate, said alkaline solution having a pH of from about 8 to about 10;

b. treating at least a portion of the substantially naphthenic acids-free distillate in contact with an oxidizing agent and an alkaline metal phthalocyanine solution having a pH of from about 9 to about 14, and oxidizing the residual catalyst toxins and toxin precursors contained therein, and converting a portion of the mercaptans to disulfides;

c. passing at least a portion of the resulting reaction mixture from step b through a bed of solid adsorbent particles and adsorbing said oxidized toxins, toxin precursors, and the metal phthalocyanine solution on said adsorbent;

d. treating at least a portion of the toxin-free and toxin precursor-free distillate from step c in contact with an alkaline solution and a supported metal phthalocyanine catalyst in the presence of an oxidizing agent, said alkaline solution having a pH of from about 9 to about 14; and e. recovering the resultant distillate from step d substantially free of mercaptans.

2. The process of claim 1 further characterized with respect to step (a) in that said treatment is effected at a temperature of from about 10° to about 200° C. and a pressure of from about 1 to about 100 atmospheres.

3. The process of claim 1 further characterized with respect to step (b) in that said treatment is effected at a temperature of from about 10° to about 100° C. and a pressure of from about 1 to about 100 atmospheres.

4. The precess of claim 1 further characterized with respect to step (c) in that said reaction mixture is passed through a bed of activated charcoal at a liquid hourly space velocity of from about 0.5 to about 10, and at a temperature of from about 10° to about 100° C. and a pressure of from about 1 to about 100 atmospheres.

5. The process of claim 1 further characterized with respect to step (d) in that said treatment is effected at a temperature of from about 10° to about 250° C. and a pressure of from about 1 to about 100 atmospheres.

6. The process of claim 1 further characterized in that said alkaline solution of steps (a), (b) and (d) is an aqueous caustic solution.

7. The process of claim 1 further characterized in that said metal phthalocyanine catalyst of steps (b) and (d) comprises cobalt phthalocyanine.

8. The process of claim 1 further characterized in that said metal phthalocyanine catalyst of steps (b) and (d) comprises iron phthalocyanine.

9. The process of claim 1 further characterized with respect to step (c) in that said solid adsorbent is an activated charcoal derived from lignite coal.

10. The process of claim 1 further characterized with respect to step (c) in that said solid adsorbent is an activated charcoal derived from bituminous coal.

11. The process of claim 1 further characterized with respect to step (c) in that said solid adsorbent is an activated charcoal derived from a vegetable source.

12. The process of claim 1 further characterized with respect to step (d) in that said supported metal phthalocyanine catalyst is cobalt phthalocyanine supported on a lignite coal-derived charcoal.

13. The process of claim 1 further characterized with respect to step (d) in that said supported metal phthalocyanine catalyst is cobalt phthalocyanine supported on a bituminous coal-derived charcoal.

14. The process of claim 1 further characterized with respect to step (d) in that said supported metal phthalocyanine catalyst is cobalt phthalocyanine supported on a vegetable-derived charcoal.

* * * * *